US011213828B2

(12) United States Patent
Künzle et al.

(10) Patent No.: US 11,213,828 B2
(45) Date of Patent: Jan. 4, 2022

(54) DEVICE AND METHOD FOR COMMINUTING BULK MATERIAL GRAINS

(71) Applicant: BÜHLER AG, Uzwil (CH)

(72) Inventors: Simon Künzle, Bazenheid (CH); Daniel Rickenbach, Wittenwil (CH)

(73) Assignee: BÜHLER AG, Uzwil (CH)

( * ) Notice: Subject to any disclaimer, the term of this patent is extended or adjusted under 35 U.S.C. 154(b) by 0 days.

(21) Appl. No.: 16/759,936

(22) PCT Filed: Oct. 29, 2018

(86) PCT No.: PCT/EP2018/079567
§ 371 (c)(1),
(2) Date: Apr. 28, 2020

(87) PCT Pub. No.: WO2019/086375
PCT Pub. Date: May 9, 2019

(65) Prior Publication Data

US 2020/0391217 A1 Dec. 17, 2020

(30) Foreign Application Priority Data

Oct. 30, 2017 (EP) ..... 17199189
Oct. 24, 2018 (EP) ..... 18202393

(51) Int. Cl.
*B02C 9/02* (2006.01)
*B02C 4/12* (2006.01)
(Continued)

(52) U.S. Cl.
CPC ..... *B02C 9/02* (2013.01); *B02C 4/12* (2013.01); *B02C 4/16* (2013.01); *B02C 4/18* (2013.01); *B02C 4/24* (2013.01)

(58) Field of Classification Search
CPC .... B02C 4/12; B02C 4/16; B02C 4/18; B02C 4/24; B02C 4/26; B02C 9/02; B02C 25/00
(Continued)

(56) References Cited

U.S. PATENT DOCUMENTS 217,844 A 7/1879 Butts
673,402 A 5/1901 Levy
(Continued)

FOREIGN PATENT DOCUMENTS

CA 257653 A 1/1926
CA 269343 A 3/1927
(Continued)

OTHER PUBLICATIONS

International Search Report Corresponding to PCT/EP2018/079567 dated Feb. 5, 2019.
(Continued)

*Primary Examiner* — Faye Francis
*Assistant Examiner* — Mohammed S. Alawadi
(74) *Attorney, Agent, or Firm* — Michael J. Bujold; Finch & Maloney PLLC

(57) ABSTRACT

A device for comminuting bulk material grains (K) having a first element, designed as a rotor having a cylindrical circumferential surface with a first surface (31) and a first receiving portion (41), and a second element designed as a shear strip (51) having a second surface (61) and a second receiving portion (71), and a supply unit. The first and the second surfaces (31, 61) lie parallel to and face one another. The first and second elements are relatively movable between first and second positions (P1, P2) in a plane of the first and the second surfaces (31, 61). In the first position (P1), the first and second receiving portion (41, 71) communicate with one another, via a passage (9) forming a
(Continued)

Figure 1:
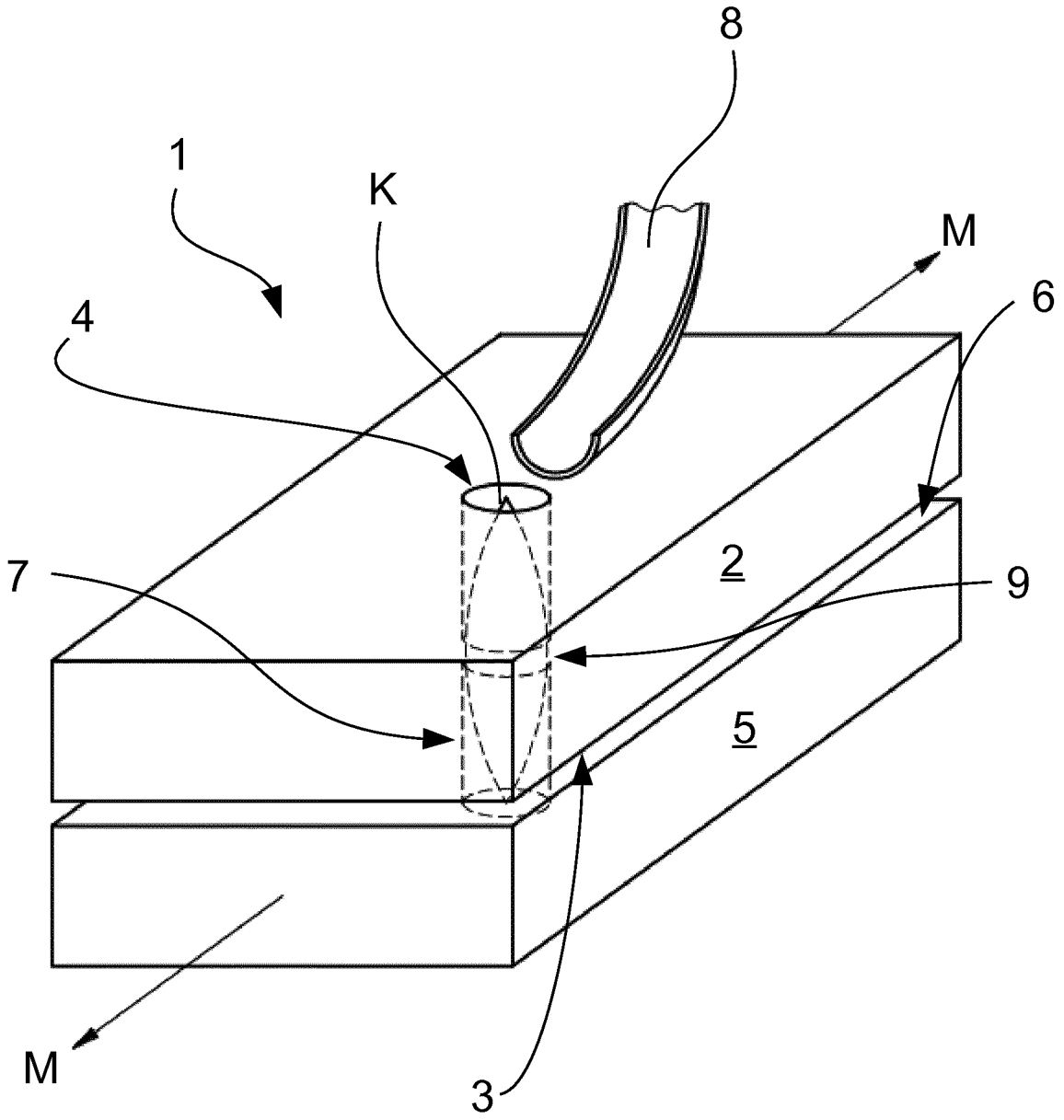

receptacle, in which the bulk material grain (K) can be positioned, and, upon moving to the second position (P2), a cross section of the passage (9) is narrowed.

14 Claims, 9 Drawing Sheets

(51) Int. Cl.
*B02C 4/16* (2006.01)
*B02C 4/18* (2006.01)
*B02C 4/24* (2006.01)

(58) Field of Classification Search
USPC ..... 241/270, 282, 285.2–285.3
See application file for complete search history.

(56) References Cited

U.S. PATENT DOCUMENTS

| | | | | |
|---|---|---|---|---|
| 1,584,869 | A * | 5/1926 | Ladd | B02C 23/02 |
| 1,672,945 | A | 6/1928 | Kipp, Jr. | |
| 1,688,770 | A | 10/1928 | Woodhead | |
| 1,744,169 | A | 1/1930 | Kipp, Jr. | |
| 1,749,925 | A | 3/1930 | Schaefer | |
| 1,954,613 | A | 4/1934 | Breeze | |
| 1,973,169 | A | 9/1934 | Ielfield | |
| 2,589,307 | A * | 3/1952 | Symons | B02C 9/02 241/252 |
| 2,597,279 | A | 5/1952 | Bailey | |
| 2,601,490 | A | 6/1952 | Bailey | |
| 2,884,036 | A * | 4/1959 | Symons | B02C 9/02 241/55 |
| 1,489,503 | A | 2/1980 | Giguere | |
| 4,189,503 | A | 2/1980 | Giguere | |
| 6,634,577 | B2 * | 10/2003 | Horigane | B02C 4/06 241/235 |
| 2005/0077406 | A1 * | 4/2005 | Everson | B02C 4/08 241/235 |
| 2012/0305689 | A1 | 12/2012 | Bach et al. | |
| 2016/0002902 | A1 * | 1/2016 | Kim | B02C 23/10 241/19 |

FOREIGN PATENT DOCUMENTS

| | | | |
|---|---|---|---|
| CA | 272090 | A | 7/1927 |
| CH | 146524 | | 4/1931 |
| CN | 202263626 | U | 6/2012 |
| DE | 592 104 | | 1/1932 |
| DE | 612 789 | | 4/1935 |
| DE | 619 661 | | 10/1935 |
| DE | 657 138 | | 2/1938 |
| DE | 699 223 | | 11/1940 |
| DE | 819 616 | | 11/1951 |
| DE | 1 101 110 | | 3/1961 |
| DE | 1 123 537 | | 2/1962 |
| DE | 1 137 290 | | 9/1962 |
| DE | 1 173 773 | | 7/1964 |
| DE | 10 2011 105 321 | A1 | 12/2012 |
| EP | 1 151 797 | A1 | 11/2001 |
| GB | 243 721 | | 8/1926 |
| GB | 426 589 | | 4/1935 |
| GB | 977 636 | | 12/1964 |
| KR | 10-2011-0126299 | | 11/2011 |
| KR | 10-2012-0000589 | | 1/2012 |
| PL | 176538 | B1 | 12/1996 |
| ZA | 7906612 | | 11/1980 |

OTHER PUBLICATIONS

Written Opinion Corresponding to PCT/EP2018/079567 dated Feb. 5, 2019.
International Preliminary Report on Patentability Corresponding to PCT/EP2018/079567 dated May 14, 2020.

* cited by examiner

DEVICE AND METHOD FOR COMMINUTING BULK MATERIAL GRAINS

The invention relates to a device for comminuting bulk grains and in particular cereal grains and kernels. The invention further relates to a process for comminuting bulk material grains with a device according to the invention.

So-called groat-cutting machines are known, for example, from U.S. Pat. No. 1,744,169 and EP 1 151 797 A1. These devices comprise a perforated hollow drum, which is mounted so as to be horizontally rotatable. The grain to be cut is transported into the interior of the rotating hollow drum and falls through the openings of the hollow drum. The grain grains protruding from the openings are then stripped and cut by knives.

The disadvantage of such devices is that not all cereal grains are cut on the first pass. The comminuting device is therefore always followed downstream by at least one separating device (e.g. classifier or trieur), which sorts out any cereal grain that has not been cut or have been insufficiently cut, which is then returned to the device. Furthermore, the size distribution of the cut cereal grains is very wide and unsatisfactory.

It is therefore the problem of the present invention to provide a device for comminution of bulk material grains which avoids the disadvantages of the known art and in particular enables a more efficient and uniform comminution of bulk material grains and does not require a downstream separating device.

The problem is solved with a device according to the independent claim.

The device according to the invention can be used in the following fields:

- Processing of grain, grain milling products and grain end products from milling or specialty milling;
- Processing of legumes;
- Production of food for farm animals, pets, fish and crustaceans;
- Processing of oil seeds;
- Processing of biomass and production of energy pellets;
- industrial malting and milling plants;
- Processing of cocoa beans, nuts and coffee beans.

According to the present invention, cereal grains are both fruits from plants of the genus sweet grass as well as from so-called pseudo-cereal plants such as quinoa and buckwheat. Cereal kernels are cereal grains which have been husked/skinned.

The device for comminuting bulk material grains according to the invention comprises a first member having a first surface and a first receiving section, a second member having a second surface and a second receiving section, and a feeding device.

The device according to the invention is particularly suitable for the comminution of cereal grains and kernels.

The first surface and the second surface are arranged parallel and facing each other. Preferably the first surface and the second surface contact each other.

The first element and the second element can also be moved back and forth relative to each other between a first position and a second position. The direction of movement, i.e. the movement vector of the first element and the second element lies in the plane of the first surface and the second surface.

When the first element and the second element are in the first position, the first pick-up section and the second pick-up section communicate with each other via a passage, thereby forming a receiving area in which a bulk grain can be positioned via the feeding device.

When moving the first element and the second element from the first position to the second position, a cross-section of the passage is narrowed so that a bulk grain of material in the receiving area is subjected to a shearing force and broken or comminuted.

The cross-section of the passage is in a plane parallel to the first surface and the second surface. The virtual area of the passage (since it is not a physical surface) is reduced when the first element and the second element are moved.

In the simplest case, the feeding device can be a simple opening which allows the bulk grain to be positioned in the receiving section.

The first receiving section and the second receiving section are designed as a recess, in particular a groove.

In such a case, the receiving section is defined by the recess or groove and an enveloping surface of the first or second element. In particular, the enveloping surface comprises the imaginary continuation of the first or second surface in the area of the recess or groove.

Alternatively, the first receiving section and/or the second receiving section can be designed as a through hole.

According to this very simple embodiment, the openings of the receiving sections on the first surface and the second surface are arranged one above the other in the first position, so that a passage is formed between the first receiving section and the second receiving section. Preferably, the openings of the receiving sections on the first surface and the second surface are designed identically so that they are aligned. In this case, a cross-section of the passage corresponds to a cross-section of the opening of the receiving section on the first and second surfaces.

It is understood that the first element and the second element may also comprise a plurality of first receiving sections and second receiving sections, each forming a corresponding plurality of receiving areas.

It is also possible that only one receiving section is designed as a through hole and the other receiving section is designed as a recess or groove.

The first element is formed as a rotor mounted for rotation about a rotor axis and having a cylindrical circumferential surface, the first receiving portion being an at least partially formed circumferential groove.

The rotor here has an axial groove which crosses the circumferential groove. The first surface is formed as a side wall of the axial groove.

The second element is designed as a shear bar, is arranged in the axial groove and is mounted so as to be movable back and forth along the axial groove, the second receiving section being a recess of the shear bar.

Preferably the recess of the shear bar is designed as a continuation of the circumferential groove of the rotor, when shear bar and rotor are in the first position.

By "partially formed circumferential groove" is meant that the circumferential groove does not necessarily have to extend over the entire circumference of the rotor, but can also be formed only in sections on the circumferential surface.

The circumferential groove can have an annular or a helical shape.

By "axial groove" is meant that the groove is parallel to the rotor axis.

The axial groove can be formed by a material recess in the rotor surface. It is also conceivable that strips on a rotor surface are arranged at a distance from each other and aligned parallel to the rotor axis, so that a groove is formed between the strips.

When operating the device, the rotor is turned around the rotor axis. Bulk material grains are fed to the circumferential groove and the recess via the feeding device.

Preferably, the device further comprises a housing with a housing wall which at least partially coaxially surrounds the rotor and has at least one feed opening and at least one outlet opening for the bulk material grains.

It goes without saying that in such a design, the feeding device includes the feed opening.

Preferably the feeding is made through a feed opening in the housing wall, which extends along an axial direction, preferably over the entire height of the rotor.

Preferably the housing wall has at least one movable housing wall section. The movable housing wall section is arranged in such a way that, when viewed radially with respect to the rotor axis, the movable housing wall section overlaps the first receiving section and the second receiving section.

If the rotor has several first and second receiving sections, a corresponding number of movable housing wall sections are preferably provided, which are arranged adjacent in the axial direction. If the rotor has a plurality of shear bars, preferably in the circumferential direction of the rotor, several housing wall sections are also arranged next to each other.

This ensures that foreign bodies, which are harder than the bulk material grains to be comminuted and can damage the rotor, are pressed radially outwards from the circumferential groove and/or the recess by the profile of the same. The movable housing wall section thus enables a displacement of the foreign body radially outwards.

The movable housing wall section can be designed as a hinged flap, for example. However, the housing wall section is preferably designed and mounted in such a way that an essentially translatory movement in radial direction is possible.

The movable housing wall section is preferably preloaded in the direction of the rotor, in particular preloaded in the radial direction of the rotor. The preload can be achieved by means of an elastic element and is preferably implemented with a spring element whose spring preload force is preferably adjustable. By adjusting the spring preload force, the movable housing wall section can be adapted to the bulk material grains to be shredded so that only foreign bodies cause a displacement of the housing wall section.

Preferably, the at least one movable housing wall section interacts with a motion sensor to detect a movement of the movable housing wall section.

With the motion sensor, thus the movement of the moving section of the housing wall and thus the presence of a foreign body can be detected. It may then be provided, for example, to stop the device to protect the rotor or to sort out the bulk material grains on the basis of the foreign body contained.

The motion sensor preferably comprises a flexible line and a process sensor, especially a pressure or level sensor. The flexible line is filled with a fluid, preferably a liquid, and is arranged radially with respect to the rotor axis further away from the rotor axis than the movable housing wall section. The flexible line is arranged in the housing in such a way that a movement of the movable housing wall section causes an elastic deformation of the line, which in turn causes a change of pressure or level in the flexible line. The process sensor enables the determination of a change of pressure or level in the line, which is due to the movement of the movable housing wall section.

Particularly preferred the line is arranged essentially parallel to the rotor axis and filled with a liquid, whereby a change in the liquid level in the line can be detected by means of a capacitive sensor.

The change of the liquid level can be detected by directly determining the liquid level or by determining the displacement of a float in the line.

According to a preferred embodiment, the feed opening is equipped with a braking device which slows down the feeding of the bulk grains and supports the intake of the bulk grains into the receiving area.

Preferably, this braking device is designed as a grid, which is attached to the feed opening. A storage chamber is also provided on the side facing away from the rotor. The bulk material grains accumulate in the storage chamber and thus pass through the grid with the correspondingly selected large perforation to the rotor, line up in the circulation groove and are carried along by the rotation of the rotor.

The rotor axis preferably is arranged vertical.

Due to the relative movement of the shear bar relatively to the rotor, the cross-section of the passage at the transition between the circumferential groove and the recess of the shear bar is reduced and the bulk material grains are thus comminuted. The comminuted bulk material grains then leave the device through the outlet opening.

The circumferential groove is preferably designed such that the comminuted bulk material grains can leave the circumferential groove, e.g. by gravity.

In addition or alternatively, a finger attached to the housing can be formed which projects into the circumferential groove and assists in leaving the circumferential groove. It is understood that in a rotor with a plurality of circumferential grooves, a kind of comb with a corresponding number of fingers can be arranged on the housing.

The preferred circumferential groove is a groove extending circumferentially. This means that with the shear bar in the first position, a circumferentially extending groove is formed from the circumferential groove and the recess.

Preferably the axial groove extends over the entire height of the rotor.

The circumferential groove and the recess preferably have a trapezoidal profile in radial section through the rotor. The profile of an isosceles trapezoid is preferred. Here the base of the trapezoid is open and coincides with the circumferential surface of the rotor. The other, shorter base side thus extends essentially parallel to the circumferential surface of the rotor.

This preferred design of the circumferential groove ensures that the bulk material grains can leave the circumferential groove on their own. In addition, damage to the rotor and/or the shear bar is substantially avoided, if solid bodies such as stones are present.

The profile of the circumferential groove ensures that solids which cannot be comminuted due to their hardness and which could damage the device are pushed outwards by the legs of the circumferential groove and the recess with respect to a rotor axis without being able to damage the rotor and/or the shear bar, especially if a movable housing wall section is provided.

Preferably, openings are then formed in the housing which allow foreign bodies to be removed from the device.

Preferably this is realized with the movable housing wall section. The movable housing wall section is preferably spring preloaded in the direction of the rotor. The spring force of the preload is selected in such a way that when foreign bodies are moved out of the circumferential groove and/or recess through the profile of the latter, the foreign body is pressed against the movable housing wall section and displaces the latter so that an opening is released through which the foreign body can leave the device.

Of course, it is desirable that the bulk material grains are fed to the device without any foreign bodies, e.g. by means of an upstream cleaning, which can be mechanical, optical, magnetic, etc.

Alternatively, a torque determination of a rotor drive can be used to detect an increased load. A shear pin can also be provided to be able to separate the rotor from the drive in case foreign bodies which cannot be comminuted enter the circumferential groove. The load on the shear bar can also be monitored or the shear bar can be secured with a shear pin/desired breaking point, which separates the shear bar from a shear bar drive in the event of overload.

The bulk material grains can also be analysed at the feed opening to detect foreign bodies and take the necessary steps.

The rotor preferably has a plurality of circumferential grooves, which in particular are equally spaced from each other.

The shear bar comprises a plurality of recesses, whereby in the first position each recess is assigned to a first circumferential groove.

This means in particular that in the first position the circumferential groove and the recess assigned to the circumferential groove each form a continuous channel in which the bulk material grains can be reduced in size.

This means that a single shearing bar can simultaneously comminute the bulk material grains located in the circumferential grooves. Another advantage is that only one actuator is required for the shear bar.

In a shear bar with a plurality of recesses, a recess assigned to a first circumferential groove in the first position is preferably assigned to a second circumferential groove in the second position, the second circumferential groove preferably being arranged adjacent to the first circumferential groove.

This means in particular that in the second position the recess, which in the first position has formed a continuous channel with its associated first circumferential groove, forms a continuous channel with another, second circumferential groove, in which the bulk material grains can be reduced. The second circumferential groove is preferably arranged adjacent to the first circumferential groove when viewed in the axial direction of the rotor.

This means that bulk material grains can be comminuted and removed from the circumferential groove or recess when the shear bar is moved from the first position to the second position, whereby bulk material grains can also be comminuted during the movement from the second position to the first position, especially if the device is equipped with several inlet and outlet openings arranged around the circumference of the rotor.

This means that per comminuting cycle the shear bar does not necessarily have to be moved from the first position to the second position and then back to the first position. With one movement from the first position to the second position (and analogously from the second position to the first position) several comminuting cycles can thus be carried out, depending on the number of circumferential grooves arranged between the first and second circumferential grooves.

Preferably the rotor comprises a plurality of shear bars, each of which is arranged in an axial groove.

The shear bars are arranged at equal distances from each other, especially on the circumferential surface of the rotor.

The shear bars are preferably arranged between 1 and 10 mm apart.

The shear bars are also preferably between 1 and 10 mm wide. In particular, the width of the shear bars is equal to the distance between the adjacent shear bars, so that uniform size reduction—i.e. a narrow particle size distribution—is achieved.

The circumferential groove preferably has a width between 1 and 10 mm and/or a depth between 1 and 10 mm.

The rotor preferably has an outer diameter between 200 and 600 mm.

The housing wall, which at least partially surrounds the rotor, is preferably arranged between 0 and 5 mm away from the circumferential surface of the rotor.

The housing wall thus serves as the end of the circumferential groove, so that when the shear bar is moved, the bulk material grains arranged in the circumferential groove remain in the circumferential groove. As already described above, the housing wall or parts of it can be provided with openings for the removal of foreign bodies and/or with movable and, if necessary, spring-loaded housing wall sections.

The rotor can preferably be driven at a speed between 5 and 100 rpm.

The shear bar can preferably be moved by means of a cam gear.

A cam gear is a very simple variant for forming an actuator for the shear bar.

However, it goes without saying that the shear bar can also be driven differently, e.g. by mechanical, pneumatic or hydraulic actuators.

The cam gear comprises at least one control cam which is arranged non-rotatably at one axial end of the rotor with respect to one direction of rotation of the rotor. The control cam is preferably in the form of a control wheel mounted so as to rotate about an axis. The control cam is arranged in such a way that an axial end of the shear bar(s) contacts the control cam and is moved axially when the rotor rotates.

Preferably, the axial end of the shear bar which interacts with the control cam comprises a punch which is axially guided in a guide bore of the rotor.

Preferably, the punch interacts with an elastic element, especially a spring element, or is already preloaded in the axial direction. This ensures that the movement between the first position and the second position is only effected in one direction from the control cam, with the elastic element moving the shear bar back in the opposite direction. Alternatively, control discs can be provided at both axial ends of the rotor, which cause the movement of the shear bar between the first position and the second position.

According to a preferred embodiment, several adjacent shear bars are assigned to a punch, so that the shear bars can be moved in groups between the first position and the second position.

Due to this preferred drive arrangement, large forces can be exerted on the shear bars, which are necessary for the comminuting of the bulk material grains. In addition, such a drive arrangement is very robust, simple in design and low in wear.

The cam gear preferably comprises a circumferential groove in which a projection of the shear bar is arranged. The circumferential groove serves as a guide for the projection of the shear bar and is designed in such a way that the shear bar is moved back and forth between the first position and the second position when the rotor is turned.

The invention further relates to a process for comminuting bulk material grains with a device according to the invention, in which process the product is not fed back. The product is thus fed to a downstream process step or stored. In contrast to processes according to the state of the art, where the particle size distribution of the devices is unsatisfactory and the product is sieved and/or separated according to shape (e.g. by a trieur) after comminution and the bulk material grains which have not been comminuted or are insufficiently comminuted are fed back to the device, with a device as described above it is possible to process the comminuted bulk material grains directly, i.e. without a separation step, without the product being fed back to the same or an analogous device.

In particular, it is possible to define the maximum particle size of the comminuted bulk material grains by selecting the dimensions of the first receiving section and the second receiving section. The distance perpendicular to the first or second surface between the plane of the passage and a boundary of the first or second receiving section determines the maximum particle size that can be achieved with the device.

In case of a device with shear bars which are equally spaced and as wide as the distance between the adjacent shear bars, the maximum grain size corresponds exactly to the width of the shear bar.

Figure 2:
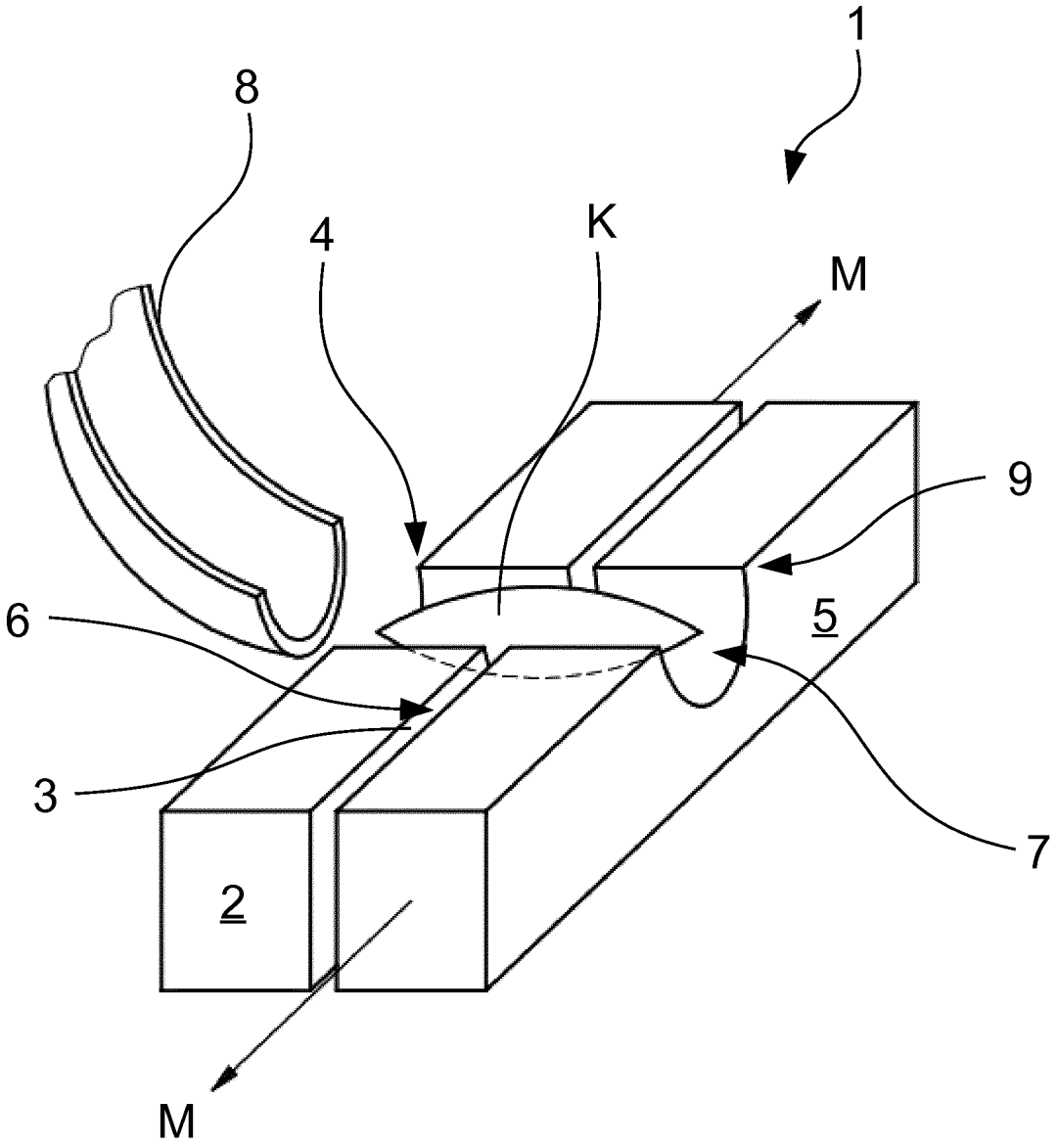
Figure 3:
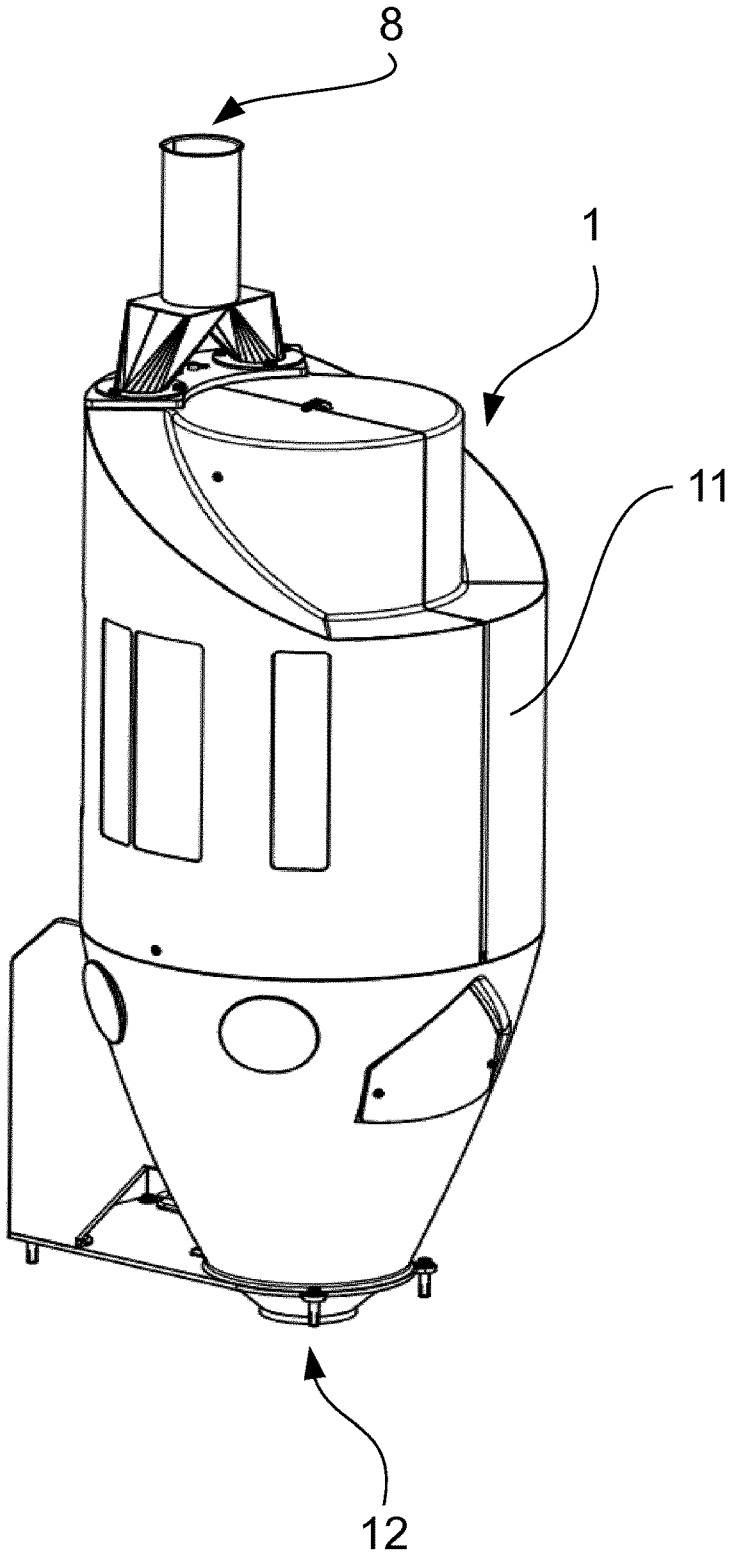
Figure 4:
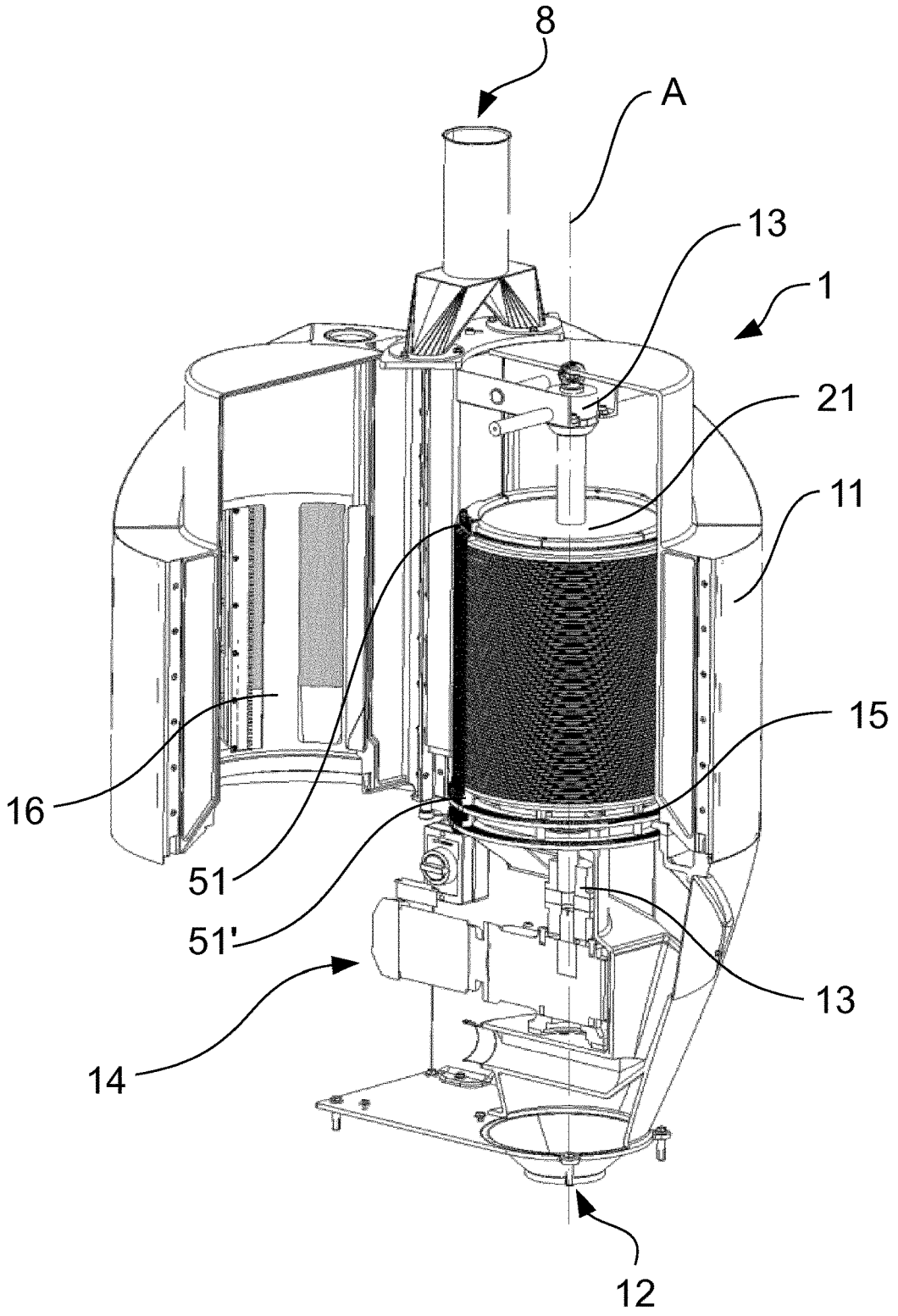
Figure 5A:
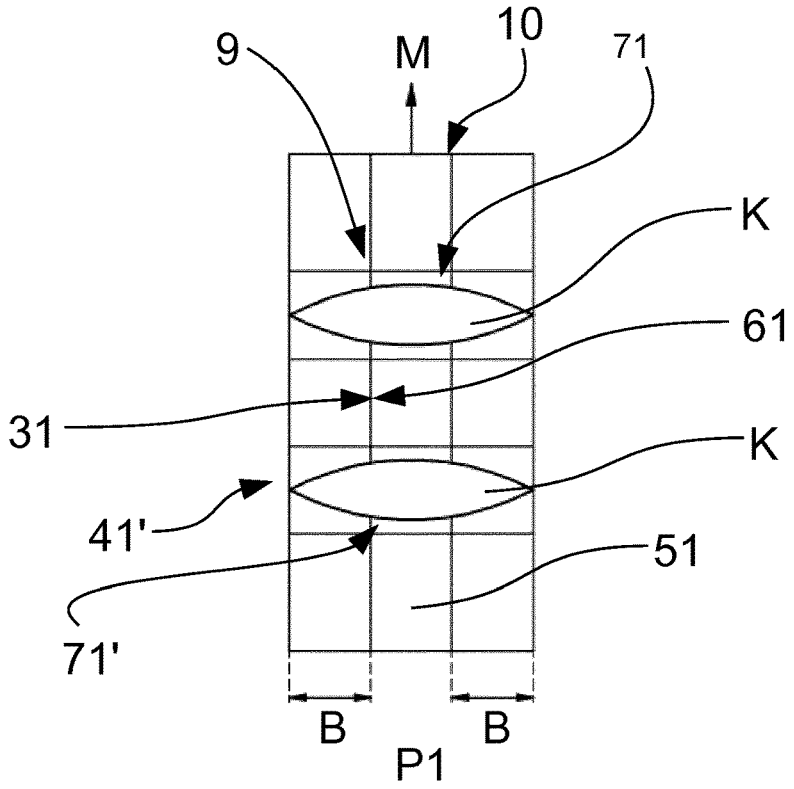
Figure 5B:
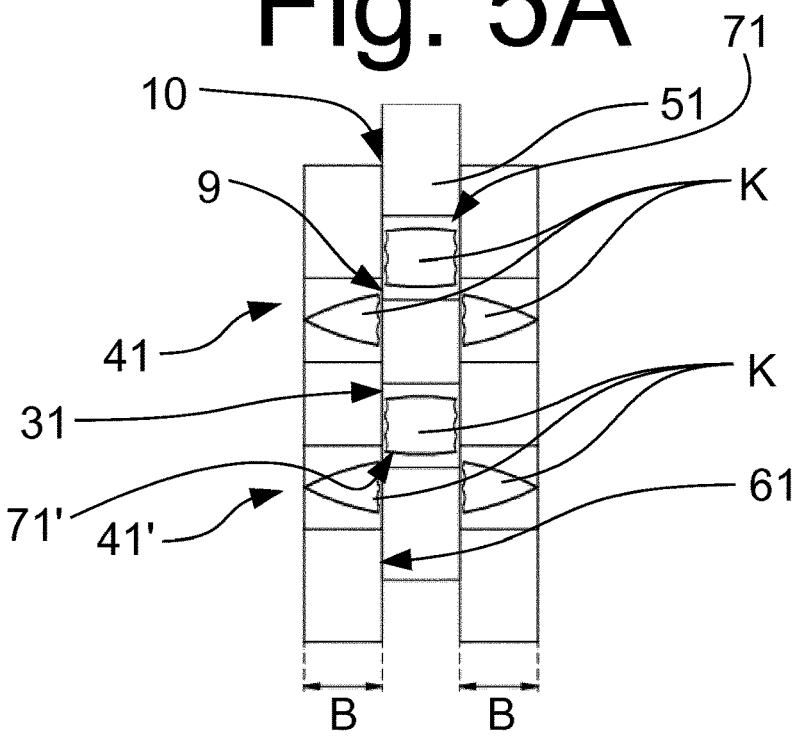
Figure 6:
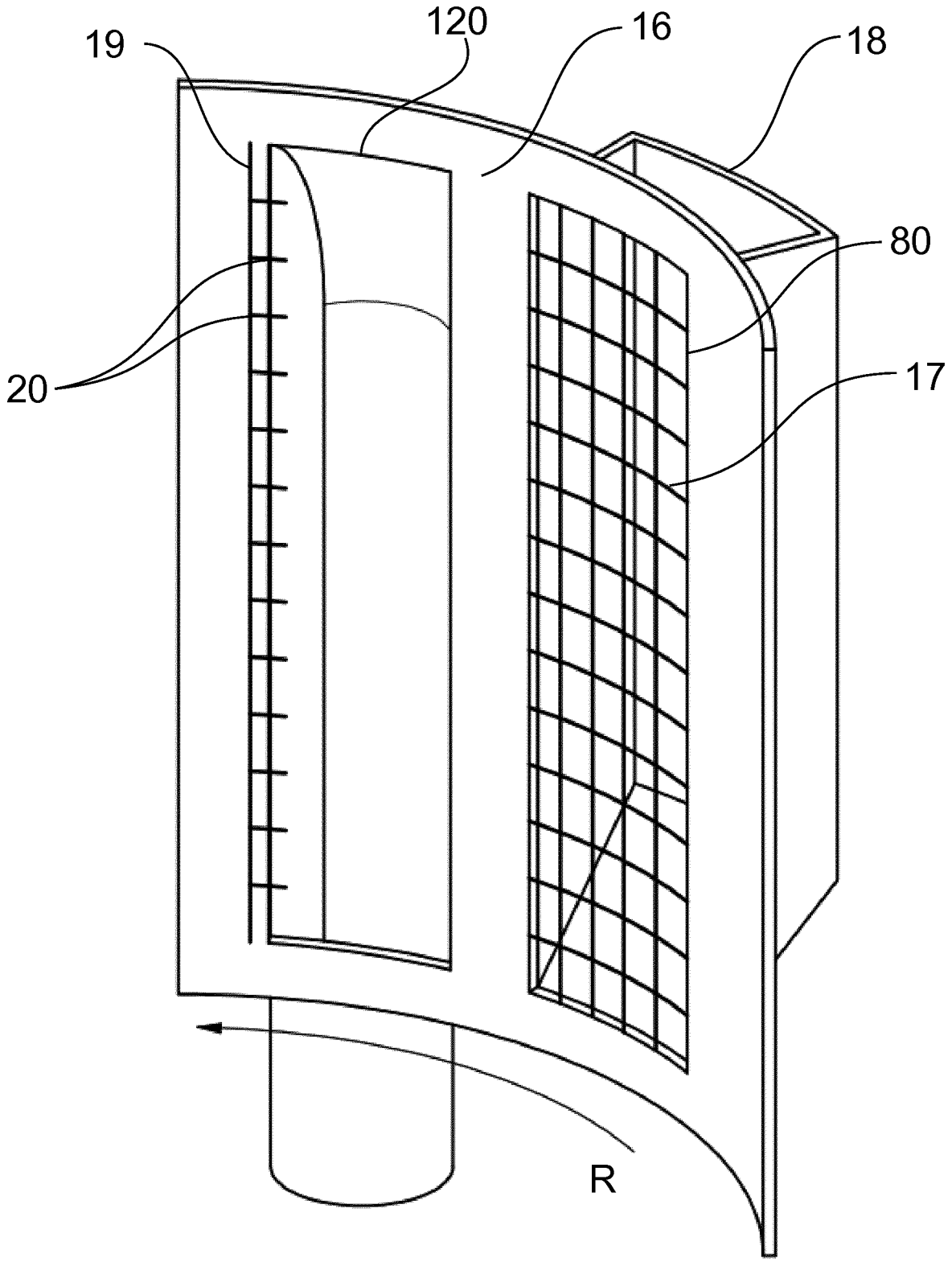
Figure 7A:
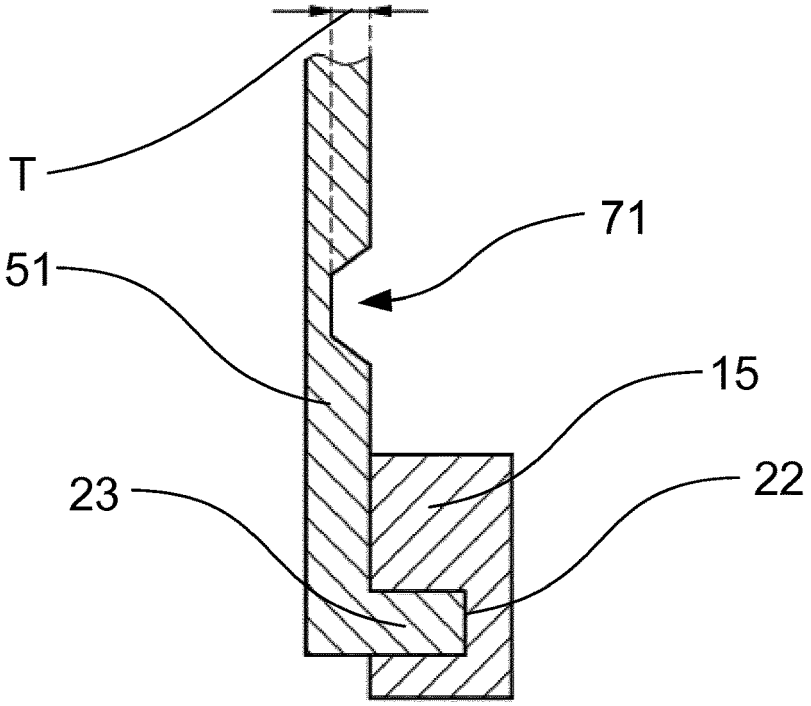
Figure 7B:
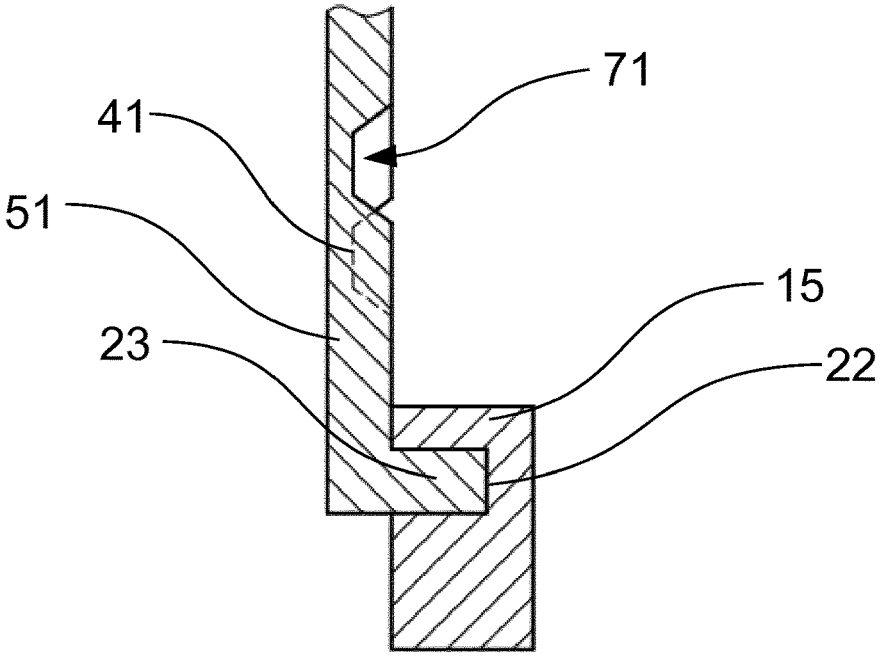
Figure 8A:
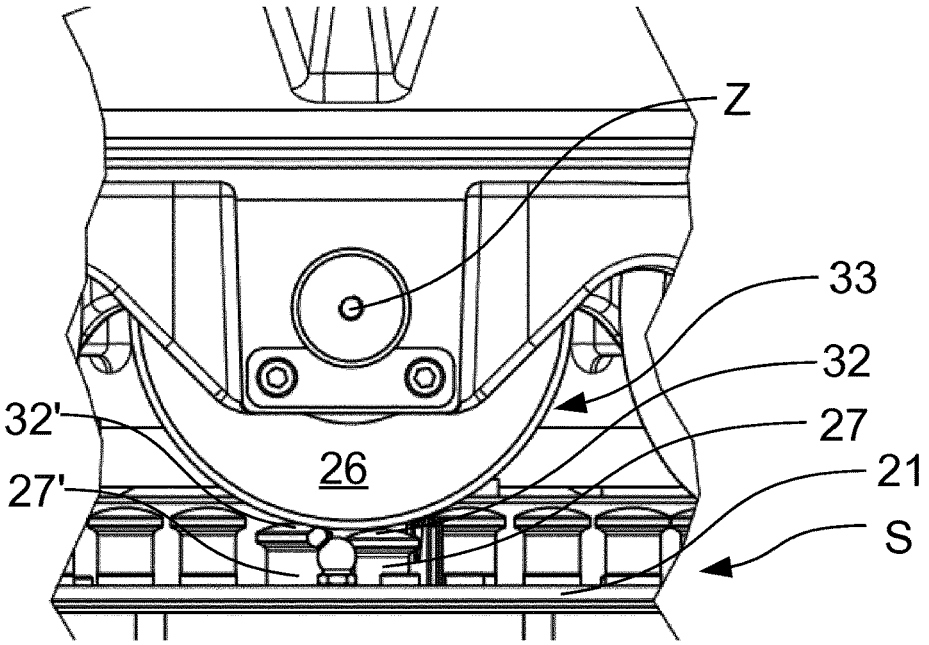
Figure 8B:
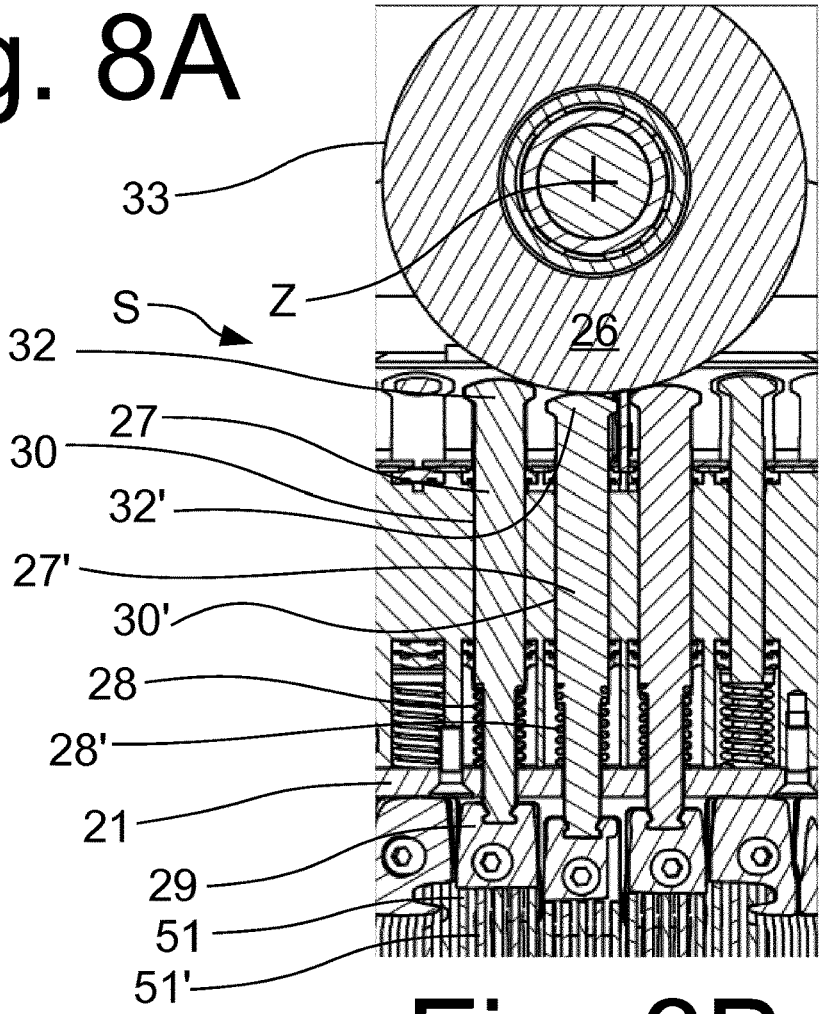
Figure 9:
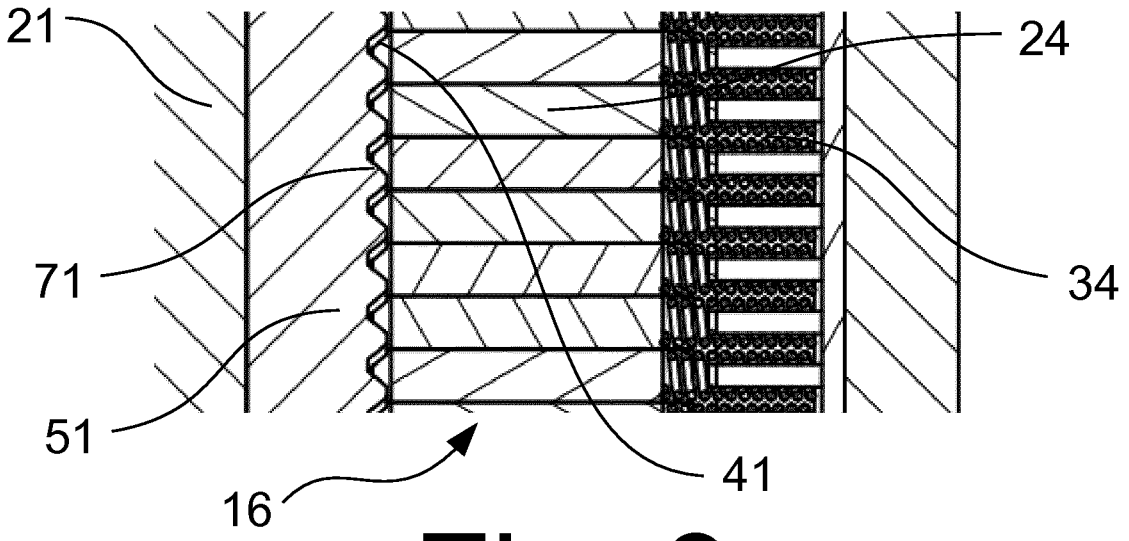
Figure 10:
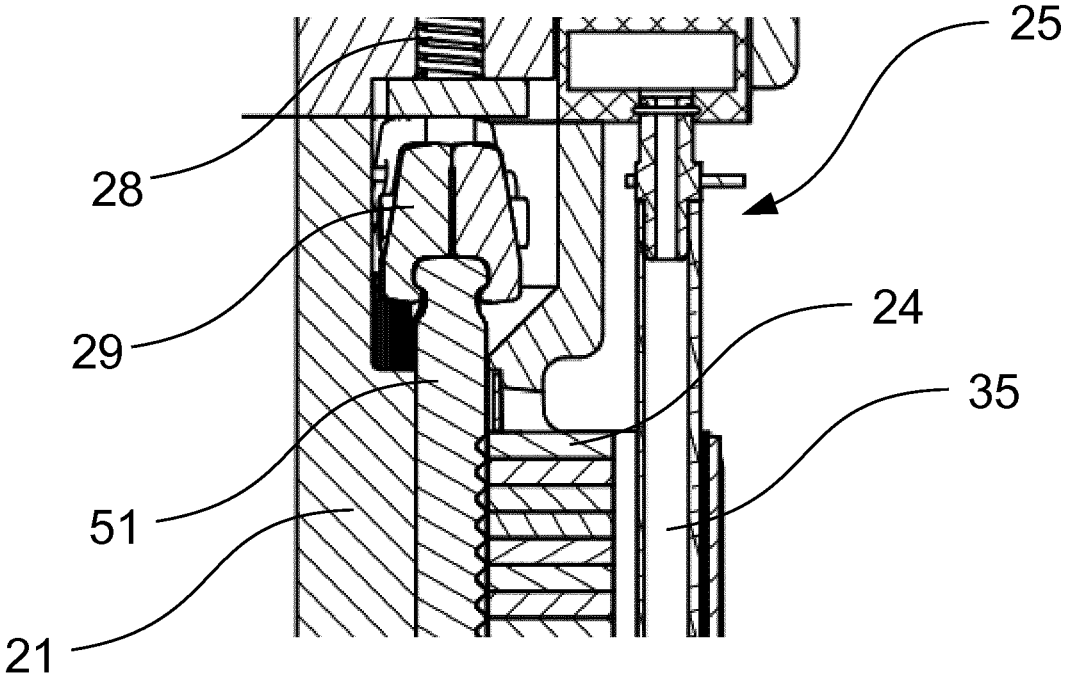

The invention is described in detail below by means of preferred examples in connection with the figures. It is shown:

FIG. 1 a schematic, perspective illustration of a first embodiment of the invention;

FIG. 2 schematic, perspective illustration of a second embodiment of the invention;

FIG. 3 a perspective view of a further development of the device of the invention with closed housing;

FIG. 4 the device of FIG. 3 with open housing;

FIG. 5A a schematic illustration of the rotor of FIG. 4 in the first position;

FIG. 5B a schematic illustration of the rotor of FIG. 4 when moving from the first position to the second position;

FIG. 6 a schematic view of the inlet and outlet openings of the device of FIG. 4;

FIG. 7A A schematic illustration of how the shear bar works in the first position;

FIG. 7B a schematic diagram of how the shear bar works when moving from the first position to the second position;

FIG. 8A A perspective view of a control cam with punches for axial movement of the shear bars;

FIG. 8B a partial sectional view of the control cam with punches;

FIG. 9 a sectional view through the housing wall with movable housing wall sections; and FIG. 10 a sectional view through the housing wall with movable housing wall sections and motion sensor.

FIG. 1 schematically shows a possible design of the device according to the invention.

The device 1 comprises a first element 2 and a second element 5, each with a through-bore, which form a first and a second receiving section 4 and 7 respectively for a bulk grain K. The receiving sections 4 and 7 thus form a receiving area for the bulk grain K. The through-bore 7 is shown dashed, as it is covered by the first element 2. Furthermore, the first and second elements 2 and 5 each have a flat surface 3 and 6 respectively, which are arranged parallel to each other. The through-bores 4 and 7 are aligned. A passage 9 connects the first through-bore 4 and the second through-bore 7.

When moving the first element 2 and/or the second element 5 along the direction of movement M from the first position P1 shown in FIG. 1, a cross-section of the passage 9 is reduced and the bulk grain is comminuted by shearing. The comminuted bulk grain K can then be removed from the device 1 through the through-bore 4 and/or 7.

The first element 2 and the second element 5 are moved back and forth between the first position P1 and a second, not shown, position P2 by means of a drive. The direction of movement M is in the plane of the first surface 3 and the second surface 6.

FIG. 2 shows an alternative embodiment of the device 1 in the first position P1.

In contrast to the device 1 of FIG. 1, however, the receiving sections 4 and 7 are designed as recesses of the respective element 2 and 5.

Also in this case, by moving the first element 2 and/or the second element 5 along the direction of movement M from the first position P1 shown in FIG. 2, a cross-section of the passage 9 can be reduced and the bulk grain can be comminuted by shearing.

FIG. 3 shows a device 1 in accordance with the invention for comminuting bulk material grains. The device 1 comprises a housing 11, which has an inlet opening 8 and an outlet opening 12 for the bulk material grains K.

In FIG. 4, the housing 11 is opened so that the internal structure of the device 1 is visible. The device 1 comprises a rotor 21 with a cylindrical circumferential surface, which is schematically shown in FIGS. 5A and 5B. The rotor 21 is rotatably mounted around a rotor axis A by means of bearings 13. A motor unit 14 comprising a motor and a gear serves as rotor drive.

In FIGS. 5A and 5B, the rotor 21 is shown schematically. The rotor 21 has a plurality of circumferential grooves 41, 41' on its circumferential surface, only two of which are shown, which are designed to receive the bulk material grains K. Each circumferential groove 41, 41' has a width B and a depth T extending in the radial direction of rotor 21 (which is shown in FIG. 7A).

Rotor 21 also has a plurality of shear bars 51, 51', of which only shear bar 51 is shown in FIGS. 5A and 5B. The shear bar 51 is located in an axial groove 10 of rotor 21 and is movable along a direction of movement M. The axial groove 10 crosses the circumferential groove 41 (and 41'). The rotor thus has a plurality of axial grooves, although FIGS. 5A and 5B show only one axial groove 10, for reasons of simplicity.

It can be seen that the functioning of the device corresponds to that of the device in FIG. 2. In this case, the first location section is formed as a circumferential groove 41 and the first surface 3 corresponds to a side wall 31 of the axial groove 10.

The shear strip 51 thus corresponds to the second element 5, whereby the second receiving section 7 is designed as recess 71 of the shear strip 51. One side surface 61 of the shearing strip 51, which is adjacent to the side wall 31 of the axial groove 10, therefore corresponds to the second surface 6 of the second element 5. Circumferential groove 41 and recess 71 have an identical cross-section in radial section through rotor 21 and are aligned in the first position P1 of FIG. 5A.

When operating the device 1, the bulk material grains K are fed via the feed opening 8 to the rotating rotor 21, where they enter the circumferential grooves 41, 41' and are carried along by the rotation of the rotor 21.

One end of the shear bars 51, 51' interacts with a cam disc 15, which is located at a front end of the rotor 21. As the rotor 21 rotates, the shear bars 51, 51' are thus moved between a first position P1 (shown in FIG. 5A) and a second position P2, not shown. The resulting reduction in the cross-section of a transition 9 between the respective circumferential grooves 41, 41' and the recess 71, 71' of shear bar 51 in the area of the intersection between the circumferential grooves 41, 41' and axial grooves 10, 10' has the effect of breaking up the bulk material grains K.

The comminuting is shown in FIG. 5B. If the width B of the circumferential groove 41, 41' corresponds to the width of the shearing bar 51, it can thus be guaranteed that the size distribution of the comminuted bulk material grains K is at most B.

After cutting the bulk material grains are removed from the circumferential groove 41, 41' and leave the device 1 through the outlet opening 12.

FIG. 6 shows separately a detail of the feed and discharge device of device 1. The inlet 8 and outlet 12 are connected by a conduit to corresponding inlet openings 80 and outlet openings 120 of a housing wall 16. According to a preferred embodiment, between 4 and 8 inlet openings 80 and outlet openings 120 are arranged around the circumference of the rotor 21, whereas only one inlet opening 80 and one outlet opening 120 are shown in FIG. 6. The inlet opening 80 is provided with a grid 17. On the side facing away from the rotor 21 a hopper 18 is arranged, which is filled with bulk grains when operating the device 1, so that it can be ensured that bulk grains can be fed to the rotor 21 over the entire height. The grid 17 supports the formation of a column of bulk material grain in the storage hopper 18 and ensures that not too many bulk material grains reach the rotor 21, which could lead to malfunctions of the device 1.

Viewed in the rotational direction R of the rotor 21, which is shown schematically by the arrow, the inlet opening 80 is followed by an outlet opening 120. A comb device 19 is attached to the housing wall 16. The comb device 19 has a plurality of fingers 20, each of which is assigned to a circumferential groove 41, 41' of the device. The fingers 20 protrude into the respective circumferential groove 41, 41' and cause the comminuted bulk material grains to be removed from the circulating groove 41, 41' and to be able to leave the device 1 for further processing through the exit opening 120.

FIGS. 7A and 7B schematically show the function of cam disk 15 as a possible drive for the shear bars 51, 51'. The shear bar 51 is shown in simplified form with only one recess 71. The cam disk 15 comprises a circumferential groove 22, which is designed to face the rotor axis A. At the lower end of the shear bar 51 a projection 23 is formed, which is accommodated in the circumferential groove 22. When the rotor 21 is turned, the shear bar 51 is turned as well, while the cam disk 15 is firmly connected to the device 1. The circumferential groove 22 is designed such that during rotation, the shear bar 51 moves axially between the first position P1 of FIG. 7A and a second position P2. FIG. 7B shows an intermediate position between the first position P1 of FIG. 7A and the second position P2, the circumferential groove 41 of rotor 21 being shown as a dotted line. It should be noted that the cross-section of the passage 9 of the shear bar 51 of FIGS. 7A and 7B is trapezoidal with a depth T.

FIGS. 8A and 8B show a further embodiment of the drive of the shear bars 51, 51'. The shear bars 51, 51' etc. are connected to a holder 29 in a tension and compression-resistant manner. The holder 29 is in turn connected to a punch 27 in a tension and compression-resistant manner. The punches 27 and 27' etc. (of which only two are provided with a reference sign, for the sake of clarity) are guided axially with respect to the axis of rotation A of the rotor 21 in an assigned guide bore 30 or 30' of the rotor 21. A spiral spring 28 surrounds the respective punch 27, 27' etc. and is supported at one of its ends on the rotor 21 and at the other end on the respective punch 27.

In the area of the axial end S of rotor 21, several control cams 26 are arranged, of which only one is visible in FIGS. 8A and 8B. Control cam 26 is mounted non-rotatably in relation to a direction of rotation of the rotor 21, so that it does not remain stationary when rotor 21 is turning, is designed as a circular control wheel and is mounted such that it can rotate freely about axis Z—i.e. without any drive.

As the rotor 21 rotates, an upper lenticular head 32 of the punch 27 comes into contact with the outer surface 33 of the control cam 26, and the punch 27 is first pressed down until it reaches the apex of the outer surface 33, the direction of movement of the punch 27 being substantially parallel to the axis of rotation A of the rotor 21. The control cam 26 is simultaneously rotated by friction around the axis Z.

The movement of the punch 27 moves the shear bars 51, 51' etc. from the first position P1 to the second position P2. Punch 27 is moved against a spring force of the spiral spring 28. The spiral spring 28 is thus compressed.

The spring force of the spiral spring 28 pushes the punch 27 upwards. By further rotation of the rotor 21 and the course of the outer surface 33, the punch 27 is moved upwards again until the holder 29 experiences a stroke against a stop surface of the rotor 21. The shear bars 51, 51' etc. thus return from the second position P2 to the starting position, which corresponds to the first position P1.

In order to increase the throughput capacity of the device 1, several control cams 26 are provided, corresponding to the examples described above, which control the shear bars 51, 51' etc. between the respective input opening 80 and output opening 120.

In FIG. 9 an axial sectional view of the rotor 21 is partly shown. The housing wall 16 comprises a plurality of housing wall segments 24, which are each assigned to a circumferential groove 41 of rotor 21 and are arranged next to each other in the axial direction of the rotor 21. For the sake of clarity, only one housing wall segment 24 is provided with a reference sign.

Each housing wall section 24 is preloaded by a spiral spring 34 in the direction of the rotor 21.

As explained above, the trapezoidal profile of the circumferential groove 41 and the recess 71 causes the bulk material grains K to be pressed against the housing wall 16 when the shear bar 51 is moved.

The pre-loading force of the spiral spring 34 is selected such that the housing wall sections 24 are not displaced when the shear bar 51 is moved. However, if a foreign body, which is hard and therefore cannot be comminuted by the device 1, enters the circumferential groove 41 and the recess 71, the trapezoidal profile causes the foreign body to be pressed against the associated housing wall section 24 and displaces it outwards in the radial direction of the rotor 21. This substantially prevents damage to the rotor 21 and in particular to the circumferential groove 41 or the recess 71 of the shear bar 51.

FIG. 10 shows a preferred further development of the housing wall 16. The housing wall 16 comprises a plurality of movable housing wall sections 24, which are designed analogously to the housing wall sections 24 in FIG. 9. The device 1 additionally comprises a motion sensor 25, which comprises a flexible line 35, which is arranged radially with respect to the axis of rotation A outside the housing wall 16, directly behind the housing wall sections 24. The flexible line 35 runs parallel to the axis of rotation A of the rotor 21 and is filled with a liquid up to a set level.

A level sensor, not shown, monitors the liquid level. The flexible line 35 is arranged in such a way that it is squeezed if a section of the housing wall 24 is moved outwards, causing the liquid level to rise. The level sensor determines the deviation of the liquid level from the set level. It can thus be detected whether one or more housing wall sections 24 have been shifted and thus that objects are contained in the device 1 which cannot be comminuted.

The invention claimed is:

1. A device for comminuting bulk material grains, comprising:

a first element having a first surface and a first receiving section, a second element with a second surface and a second receiving section, a feeding device, wherein the first surface and the second surface are arranged parallel and facing each other, the first element and the second element are movable back and forth, relative to one another, between a first position and a second position, and the direction of movement being in a plane defined by the first and second surfaces, in the first position, the first receiving section and the second receiving section communicate with each other, via a passage, and form a receiving area in which a grain of bulk material can be positioned via the feed device, when the first element and the second element are moved from the first position to the second position, a cross-section of the passage is narrowed, wherein the first element is formed as a rotor rotatably mounted about a rotor axis and having a cylindrical circumferential surface, the first receiving section is an at least partiallyformed circumferential groove, and the rotor has at least one axial groove crossing the circumferential groove, and the first surface is a side wall of the axial groove, and the second element is designed as a shear bar and is arranged in the axial groove so as to be movable back and forth along the axial groove, and the second receiving section being a recess of the shear bar; and wherein the shear bar is movable by means of a cam gear from the first position into the second position and/or from the second position into the first position, the cam a direction of rotation of the rotor at an axial end of the rotor, upon rotation of the rotor the control cam moves an axial end of the shear bar axially, the device further comprising at least one punch axially guided in a guide bore of the rotor, the punch being connected to at least one shear bar and being moved axially by the control cam upon rotation of the rotor.

2. The device according to claim 1, further comprising a housing with a housing wall which coaxially surrounds the rotor at least in sections and has at least one feed opening and at least one outlet opening for the bulk material grains.

3. The device according to claim 2, wherein the housing wall has at least one movable housing wall section which radially overlaps the first receiving section with respect to the rotor axis.

4. The device according to claim 3, wherein the at least one movable housing wall portion cooperates with a movement sensor for detecting a movement of the movable housing wall portion.

5. The device according to claim 1, wherein the rotor axis is arranged vertically.

6. The device according to claim 1, wherein the circumferential groove is a groove extending circumferentially.

7. The device according to claim 1, wherein the axial groove extends over the entire height of the rotor.

8. The device according to claim 1, wherein the circumferential groove and the recess have a trapezoidal profile in a radial section through the rotor.

9. The device according to claim 8, wherein the circumferential groove and the recess have the profile of an isosceles trapezoid, the shorter base area of the trapezoid being arranged parallel to the rotor axis.

10. The device according to claim 1, wherein the rotor has a plurality of circumferential grooves.

11. The device according to claim 10, wherein the shear bar comprises a plurality of recesses, and in the first position each recess is associated with a circumferential groove.

12. The device according to claim 11, wherein a recess associated with a first circumferential groove in the first position is associated with a second circumferential groove in the second position.

13. The device according to claim 1, wherein the rotor comprises a plurality of shear bars, each of which is arranged in an axial groove.

14. A method for processing bulk grains, comprising the following steps:

comminuting of bulk material grains with a device according to claim 1;

further processing of the comminuted bulk material grains or storage of the comminuted bulk material grains;

wherein no separation step is carried out between the comminution step and the further processing/storage step and in particular in that no feeding back of the comminuted bulk material grains to a device for comminuting bulk material takes place.

* * * * *